US008490230B2

(12) United States Patent
Rovin

(10) Patent No.: US 8,490,230 B2
(45) Date of Patent: Jul. 23, 2013

(54) DIAPER BAG HAVING AN INTEGRAL CHANGING PAD

(76) Inventor: Scott A. Rovin, Defiance, MO (US)

( * ) Notice: Subject to any disclaimer, the term of this patent is extended or adjusted under 35 U.S.C. 154(b) by 89 days.

(21) Appl. No.: 12/932,273

(22) Filed: Feb. 22, 2011

(65) Prior Publication Data

US 2011/0314608 A1 Dec. 29, 2011

Related U.S. Application Data

(60) Provisional application No. 61/358,279, filed on Jun. 24, 2010.

(51) Int. Cl.
*A47G 9/06* (2006.01)
*A45F 4/06* (2006.01)
*A45C 9/00* (2006.01)

(52) U.S. Cl.
USPC ..... 5/655; 5/417; 5/420; 224/576; 190/2

(58) Field of Classification Search
USPC ..... 5/655, 417, 419, 420; 190/1, 2, 109, 190/111; 224/576, 577; 383/4
See application file for complete search history.

(56) References Cited

U.S. PATENT DOCUMENTS

| | | | | |
|---|---|---|---|---|
| 2,540,165 | A * | 2/1951 | Fiel | 190/111 |
| 2,898,609 | A * | 8/1959 | Storie | 5/419 |
| 4,068,786 | A * | 1/1978 | Taniguchi | 224/577 |
| 4,154,323 | A * | 5/1979 | Sneider | 190/2 |
| 4,164,275 | A * | 8/1979 | Davis | 190/2 |
| 4,194,601 | A * | 3/1980 | Yellin | 190/2 |
| 4,466,517 | A * | 8/1984 | Spiegelman | 190/8 |
| 4,590,633 | A * | 5/1986 | Pickens | 5/482 |
| 4,634,618 | A * | 1/1987 | Greer et al. | 428/81 |
| 4,754,512 | A * | 7/1988 | Chao-Yang | 5/482 |
| 5,070,973 | A * | 12/1991 | Barnicoat | 190/8 |
| 5,099,530 | A * | 3/1992 | Scott | 5/420 |
| 5,160,001 | A * | 11/1992 | Marceau | 190/102 |
| 5,199,120 | A * | 4/1993 | Holmes | 5/419 |
| 5,649,658 | A * | 7/1997 | Hoffman et al. | 224/576 |
| 5,693,398 | A * | 12/1997 | Granger | 428/66.7 |
| 5,774,912 | A * | 7/1998 | Dominique | 5/419 |
| 5,785,219 | A * | 7/1998 | Kraft | 224/576 |
| 6,223,367 | B1 * | 5/2001 | French et al. | 5/419 |
| 6,298,993 | B1 * | 10/2001 | Kalozdi | 206/581 |
| 6,390,260 | B1 * | 5/2002 | Roegner | 190/109 |
| 6,393,638 | B1 * | 5/2002 | MacColl | 5/419 |
| 6,742,635 | B2 * | 6/2004 | Hirshberg | 190/2 |
| D508,620 | S | 8/2005 | Davis | |
| 7,222,705 | B1 * | 5/2007 | Guza | 190/1 |
| 7,225,483 | B1 * | 6/2007 | Remblad | 5/417 |
| 7,797,774 | B1 * | 9/2010 | Beyert | 5/655 |
| 2002/0074251 | A1 * | 6/2002 | Hirshberg | 206/315.1 |
| 2002/0084197 | A1 * | 7/2002 | Carbonneau | 206/216 |
| 2006/0289582 | A1 | 12/2006 | Killilea | |
| 2011/0314608 | A1 * | 12/2011 | Rovin | 5/655 |
| 2012/0222931 | A1 * | 9/2012 | Zuckerman | 190/2 |
| 2012/0311788 | A1 * | 12/2012 | Jackson, II | 5/655 |

* cited by examiner

*Primary Examiner* — Robert G Santos
(74) *Attorney, Agent, or Firm* — David H. Chervitz

(57) ABSTRACT

A diaper bag having an integral changing pad is disclosed which comprises a bag having an interior compartment with the bag having a top portion and a bottom portion, a cover for covering the interior compartment with the cover attached to the top portion for folding the cover over the top portion of the bag, and a changing pad having a first section connected to a second section and the second section connected to the bottom portion with the first section and the second section for being folded up in the interior compartment or unfolded out of the interior compartment.

20 Claims, 10 Drawing Sheets

DIAPER BAG HAVING AN INTEGRAL CHANGING PAD

RELATED APPLICATION

This application claims priority to U.S. Provisional Patent Application Ser. No. 61/358,279, filed on Jun. 24, 2010, the disclosure of which is incorporated herein by reference.

BACKGROUND

This disclosure relates generally to a diaper bag, and more particularly, to a diaper bag having an integral changing pad.

Diaper bags are common means for transporting baby supplies such as diapers, bottles, blankets, towels, and wipes. Although such bags are useful for carrying baby supplies when a parent needs to change an infant, a separate changing table or pad is required to place the baby upon when changing a baby's diaper. Some public restrooms are now equipped with a changing table or a wall-mounted folding changing table upon which may be placed a baby for diaper changing purposes. However, such tables do not have a pad for placing the baby on and the cleanliness of such tables are questionable. There are also some diaper bags that include a stowaway diaper changing pad. These diaper changing pads are rather flimsy in nature and design and do not provide adequate padding for support of an infant. Further, such diaper changing pads are not substantial and are not comfortable. Also, these changing pads are randomly placed in the diaper bags and may not be easily found in the diaper bags. Due to the design and configuration of the diaper bag, finding the necessary supplies once the changing pad is taken out of the diaper bag may be inconvenient or not readily available. Therefore, there is a need to provide a diaper bag having an integral changing pad that may be employed to easily change a diaper of a baby. It would also be advantageous to be able to provide a diaper bag having an integral changing pad in which the changing pad is readily available and within reach of baby supplies.

The present disclosure is designed to obviate and overcome many of the disadvantages and shortcomings associated with currently available diaper bags, diaper changing pads, and changing tables. In particular, the present disclosure is a diaper bag having an integral changing pad that is capable of being folded to be stored within the diaper bag and unfolded out of the diaper bag for placing thereon a baby for diaper changing purposes. Moreover, the diaper bag having an integral changing pad of the present disclosure may be easily positioned to unfold a changing pad while at the same time providing convenient and readily accessible storage of baby supplies. Further, the integral changing pad of the present disclosure is thick and provides support and comfort to an infant placed thereon. Thicker padding also elevates an infant for changing purposes and provides a more suitable sanitary barrier between the pad and a changing surface upon which the pad is positioned.

SUMMARY

In one form of the present disclosure, a diaper bag having an integral changing pad is disclosed which comprises a bag having an interior compartment with the bag having a top portion and a bottom portion, a cover for covering the interior compartment with the cover attached to the top portion for folding the cover over the top portion of the bag, and a changing pad having a first section connected to a second section and the second section connected to the bottom portion with the first section and the second section for being folded up in the interior compartment or unfolded out of the interior compartment.

In another form of the present disclosure, a diaper bag having an integral changing pad comprises a bag having an interior compartment having a top, a bottom, and a pair of angled sides, a cover for covering the interior compartment with the cover attached to the top for folding the cover over the top of the bag, and a changing pad having a first portion connected to a second portion with the second portion being detachably mounted to the bottom of the interior compartment.

In yet another form of the present disclosure, a diaper bag having an integral changing pad comprises a bag having an interior compartment with the bag having a top portion and a bottom portion, a cover for covering the interior compartment with the cover attached to the top portion for folding the cover over the top portion of the bag, and a folding changing pad having a top edge and a bottom edge with the bottom edge being attached to the bottom portion of the bag with the changing pad being capable of being folded up in the interior compartment or unfolded out of the interior compartment.

In light of the foregoing comments, it will be recognized that a principal aspect of the present disclosure is to provide a diaper bag having an integral changing pad.

A further aspect of the present disclosure is to provide a diaper bag having an integral changing pad which is of simple construction and design, is inexpensive, and which can be easily employed with highly reliable results.

Another aspect of the present disclosure is to provide a diaper changing bag having an integral changing pad wherein the changing pad is secured to the bag during use.

A still further aspect of the present disclosure is to provide a diaper changing bag having an integral changing pad which provides ample and readily accessible storage for baby supplies.

A further aspect of the present disclosure is to provide a diaper changing bag having an integral changing pad wherein the changing pad is detachably mounted to the bag.

Another aspect of the present disclosure is to provide a diaper changing bag having an integral changing pad with the changing pad being foldable out of the bag or into the bag.

The present disclosure also provides a diaper changing bag having an integral changing pad with the changing pad being thick for the comfort and physical well being of an infant.

A still further aspect of the present disclosure is to provide a diaper changing bag having an integral changing pad with the changing pad being fitted with a sheet for additional comfort and cleanliness.

Another aspect of the present disclosure is to provide a diaper changing bag having an integral changing pad with the bag having a cover that pivots away from the changing pad so the cover is not trapped beneath the changing pad.

The disclosure will be more fully understood by reference to the detailed description, in conjunction with the following figures, wherein

DETAILED DESCRIPTION OF THE EMBODIMENTS

Figure 1:
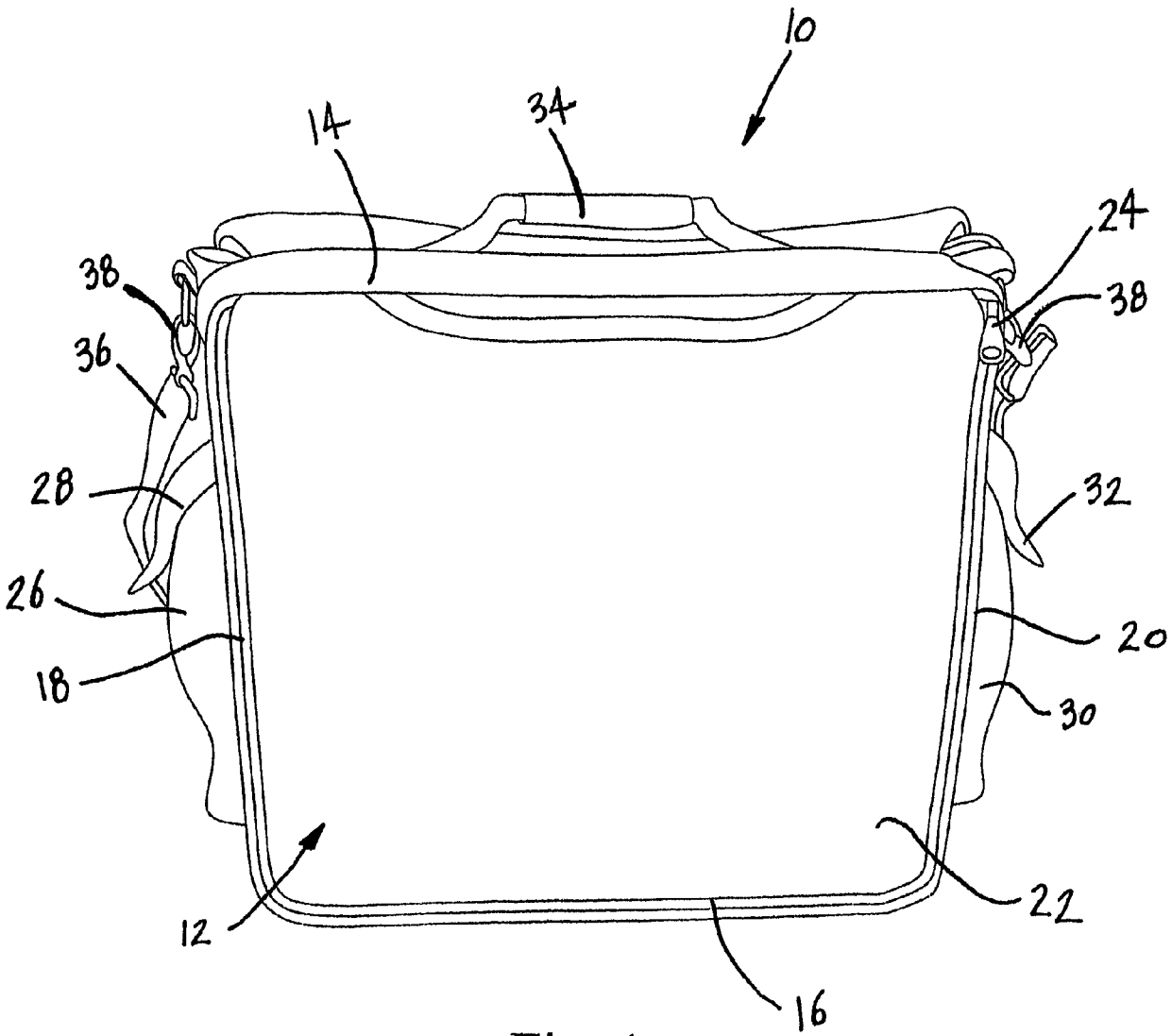
FIG. 1 is a front perspective view of an embodiment of a diaper bag having an integral changing pad constructed according to the present disclosure.

Referring now to the drawings, wherein like numbers refer to like items, number 10 identifies an embodiment of a diaper bag having an integral changing pad constructed according to the present disclosure. With reference now to FIG. 1, the diaper bag having an integral changing pad 10 comprises an outer shell 12 having a top 14, a bottom 16, a left side 18, and a right side 20. A cover 22 is attached to the bottom 16, the left side 18, and the right side 20 by use of a zipper 24. The cover 22 is attached to the top 14 by use of a hinge (not shown) which will be discussed in more detail herein. The cover 22 is used to enclose an interior compartment (not shown) of the diaper bag 10. An exterior left side pocket 26 is provided on the diaper bag 10 for holding items or supplies. The pocket 26 has a cover or flap 28 for securing any item stored within the pocket 26. The bag 10 also has an exterior right side pocket 30 for storing items or supplies. The pocket 30 has a cover or flap 32 for holding any item stored within the pocket 30. Although not shown, it is possible that the flaps 28 and 32 may include a closing device, such as a zipper, a magnet, snap, button, hook and loop fastening material, or any other closure device, for securing the flaps 28 and 32 to their respective pockets 26 and 30. The bag 10 may also include a handle 34 for carrying the bag 10. A shoulder strap 36 may be inserted into closure devices 38 for being able to attached the shoulder strap 36 to the bag 10 for carrying by use of the shoulder strap 36. The shoulder strap 36 may be adjustable to provide a comfortable fit for an individual using the bag 10. Although not shown, it is also contemplated that the bag 10 can have backpack straps so that the bag 10 can be used as a backpack.

Figure 2:
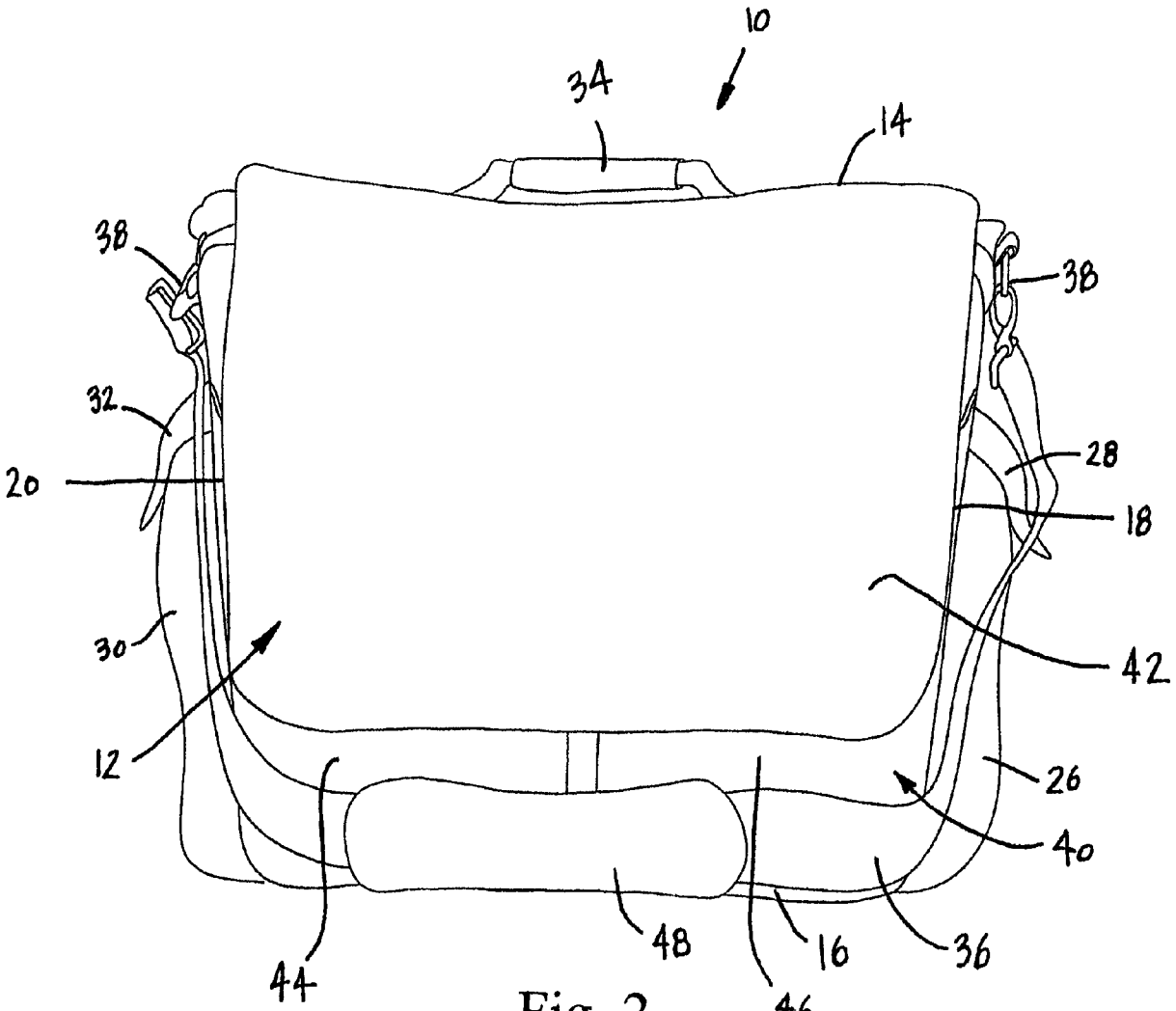
FIG. 2 is a rear perspective view of the diaper bag having an integral changing pad constructed according to the present disclosure.

FIG. 2 illustrates a rear view of the diaper bag having an integral changing pad 10. The bag 10 has a back side 40, the top 14, the bottom 16, the left side 18, and the right side 20. A flap 42 is also provided to cover a pair of storage compartments 44 and 46 of the bag 10. Although not shown, it is also possible that the flap 42 may include an exterior zippered pocket for storage of items. The shoulder strap 36 is shown having a central padded portion 48 for centering the strap 36 on a shoulder of an individual using the bag 10. The handle 34 is centrally positioned on the top 14 of the bag 10. Also, the pockets 26 and 30 are shown having their respective flaps 28 and 32 covering the pockets 26 and 30.

Figure 3:
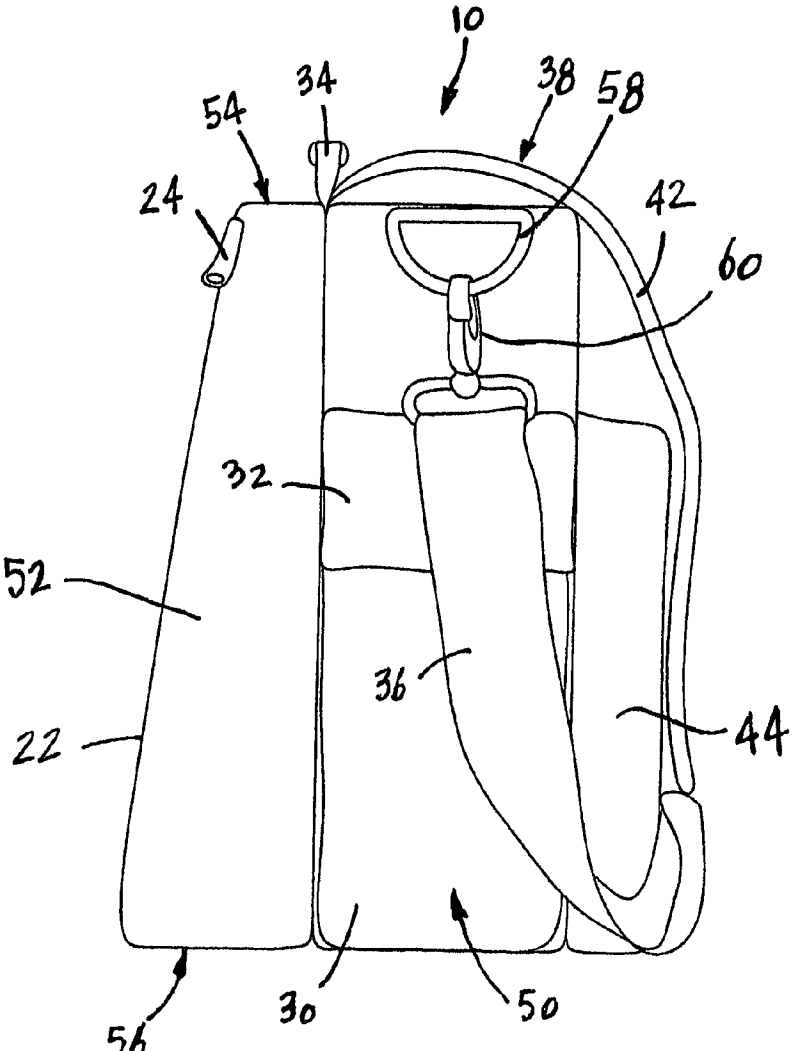
FIG. 3 is a right side view of the diaper bag having an integral changing pad.

With reference now to FIG. 3, a right side view of the bag 10 is depicted. The bag 10 has a central body portion 50 that has a storage compartment (not shown) therein. An angled side 52 extends out from the central body portion 50. The angled side 52 has a top 54 and a bottom 56. The top 54 has a length and the bottom 56 has a length with the length of the bottom 56 being greater than the length of the top 54. In this manner, an interior compartment (not shown) is formed in the bag 10. The zipper 24 is shown in a closed position holding the cover 22 in place and securing any items within an interior of the bag 10. The bag 10 is also shown having the handle 34 and the shoulder strap 36. The closure device 38 comprises a D ring 58 and a latching device 60 such as a carabiner type device. The handle 34 is shown positioned between the central body portion 50 and the top 54.

Figure 4:
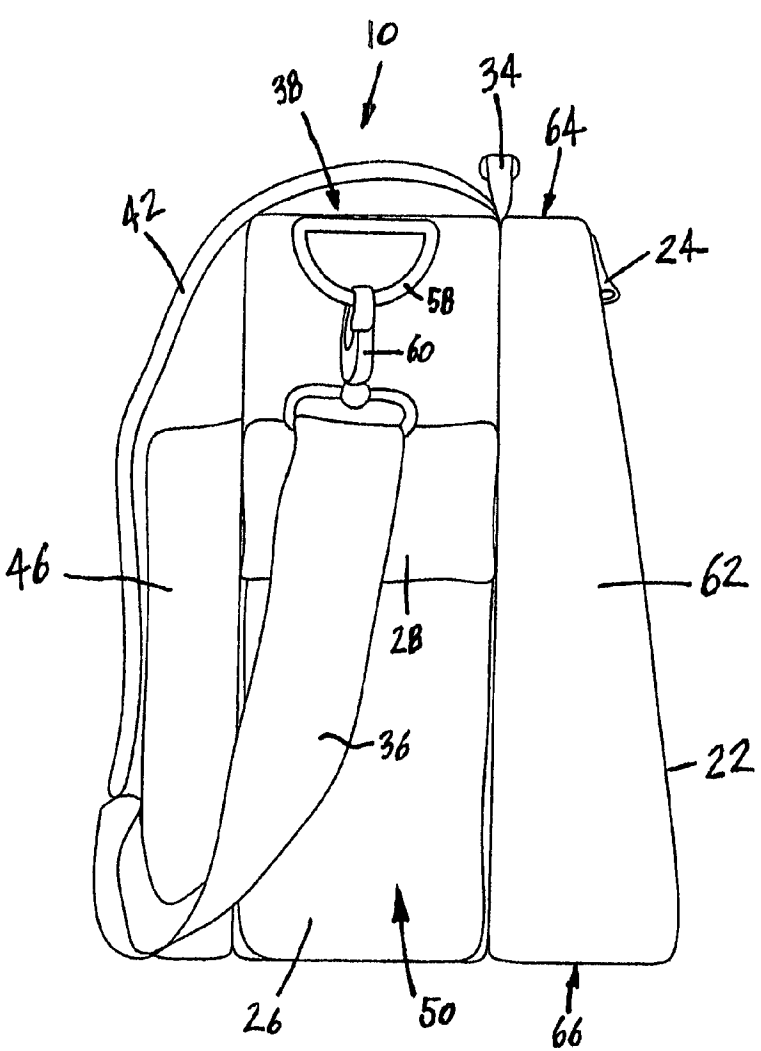
FIG. 4 is a left side view of the diaper bag having an integral changing pad.

FIG. 4 shows a left side view of the bag 10. The bag 10 has the central body portion 50 and an angled side 62 that extends out from the central body portion 50. The angled side 62 has a top 64 and a bottom 66. The top 64 has a length and the bottom 66 has a length with the length of the bottom 66 being greater than the length of the top 64. In this manner, an interior compartment (not shown) is formed in the bag 10. The zipper 24 is shown in a closed position holding the cover 22 in place and securing any items within an interior of the bag 10. The bag 10 is also shown having the handle 34 and the shoulder strap 36. The flap 42 is shown covering the pocket 46.

Figure 5:
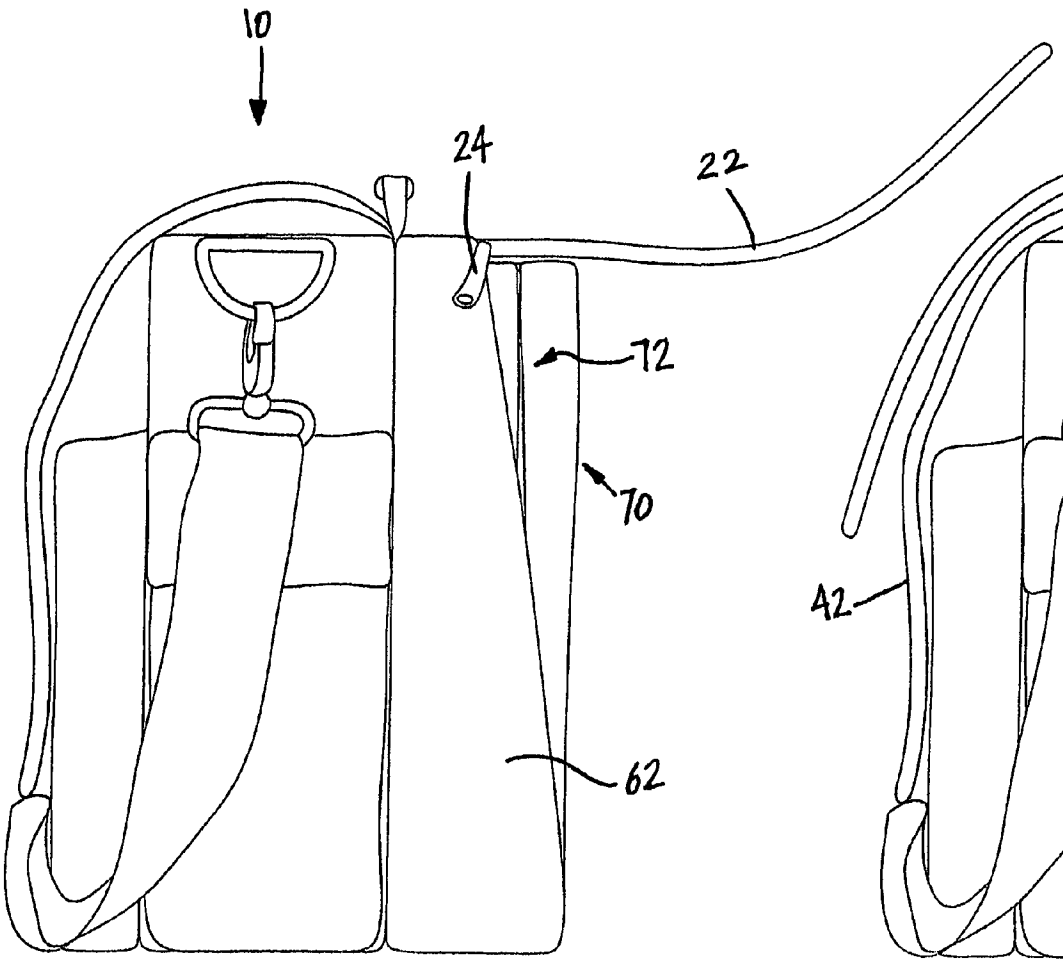
FIG. 5 is a left side view of the diaper bag having an integral changing pad with a flap portion being in an open position.

Referring now to FIG. 5, a left side view of the bag 10 is shown with the cover 22 being in an open position. In this case the zipper 24 has been unzipped from around the cover 22. The cover 22 is open to allow access to an interior compartment 70 having a changing pad 72.

Figure 6:
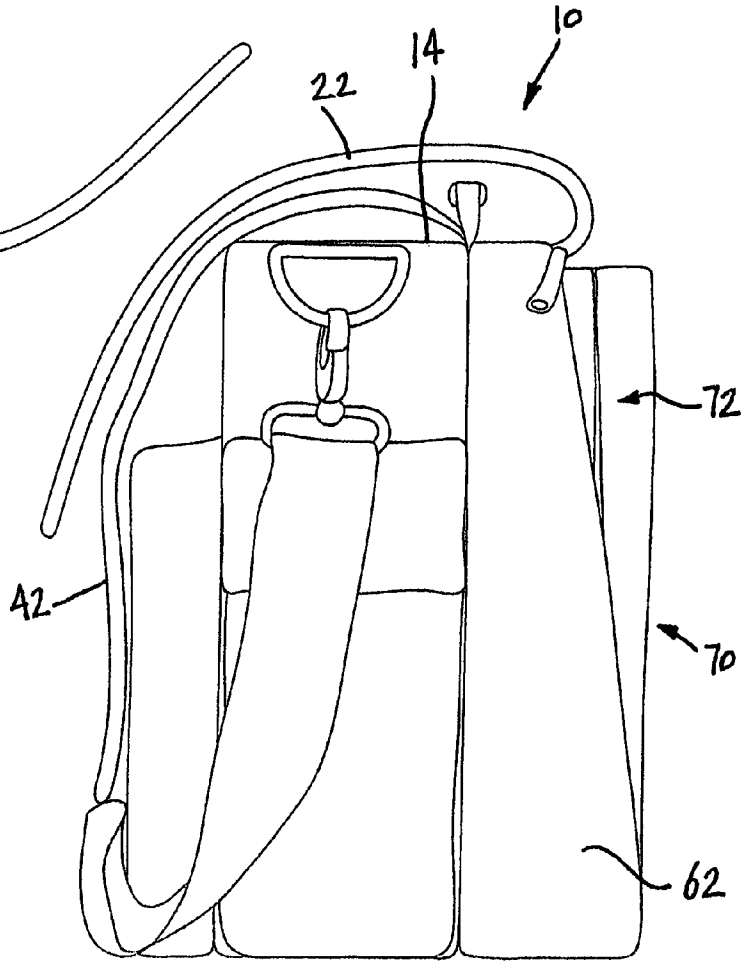
FIG. 6 is a left side view of the diaper bag having an integral changing pad with a flap portion being in a folded over position.

FIG. 6 illustrates the cover 22 being in a fully open position with the cover 22 being folded over the top 14 and the flap 42. The cover 22 is secured to the top 14. With the cover 22 in the fully open position, the changing pad 72 and any other contents of the interior compartment 70 are accessible. It is also possible and contemplated that the cover 22, when in a fully open position, may be secured to the flap 42. By way of example only, the cover 22 may be secured to the flap 42 by use of a securing device, such as a magnet, a snap, a button, hook and loop fastening material, or any other securing device. This will prevent the cover 22 from falling back over an infant placed on a changing pad.

Figure 7:
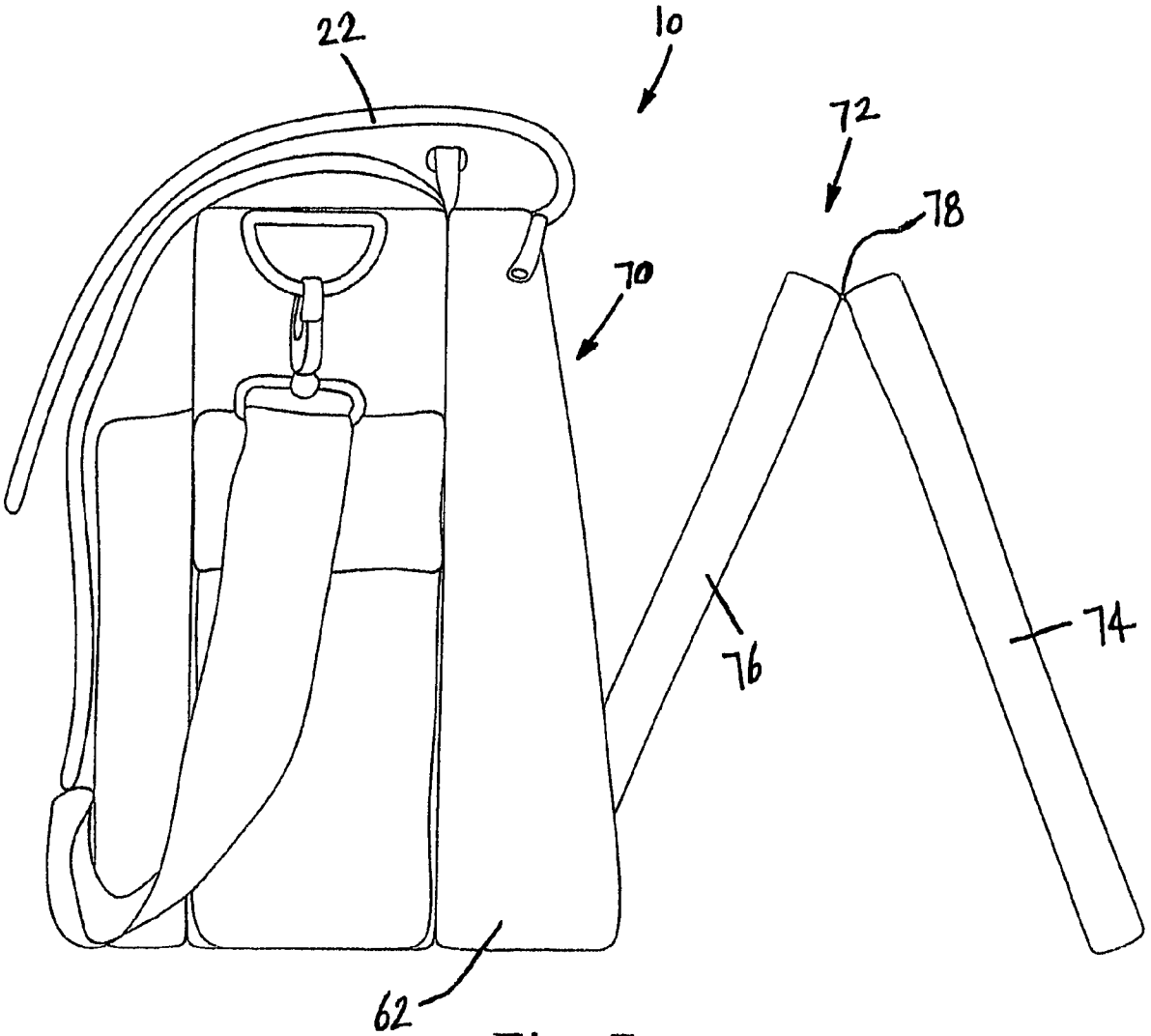
FIG. 7 is a left side view of the diaper bag having an integral changing pad with a changing pad in a partially extended position.

Referring now to FIG. 7, the bag 10 is shown with the cover 22 being in the fully open position and the changing pad 72 being partially extended or unfolded. The changing pad 72 comprises a first section 74 attached to a second section 76 by use of a hinge device 78. An example of the hinge device 78 is an extruded polyolefin living hinge such as McMaster Carr part number 1588A72. However, other hinge devices may be used. It is also possible and contemplated that the hinge device 78 may be fabric or cloth connecting the sections 74 and 76 together. In this manner the sections 74 and 76 may be folded up in the interior compartment 70 or unfolded out of the interior compartment 70 of the bag 10. Further, the cover 22 opens upward over the bag 10 so that the cover 22 does not have to be placed underneath the bag 10. This allows the bag 10 to lay flat and also allows the changing pad 72 to lay flat when extended.

The changing pad 72 may be constructed so that the sections 74 and 76 can be easily cleaned to remain sanitary. The sections 74 and 76 can be constructed in various layers having various thicknesses, and of various components. By way of example only, the sections 74 and 76 can have a rigid base of polypropylene, high density polypropylene, fiberboard, or other similar material. Attached to the base can be a central core which can be comprised of padding material such as cotton, cellulose, polyurethane foam, air bag, or other similar padding material. Surrounding the base and the central core may be an outer layer which can consists of vinyl, cotton, or other suitable flexible lightweight material that can be cleaned and that resists liquids, moisture, and germs. Furthermore, the bottom of the sections 74 and 76 may include a non-slip material to ensure that the changing pad 72 stays in place during use. In this manner, a thick changing pad 72 is provided which provides more comfort to an infant placed thereon. Also, a thick changing pad 72 elevates an infant off a changing surface which is more sanitary.

Figure 8:
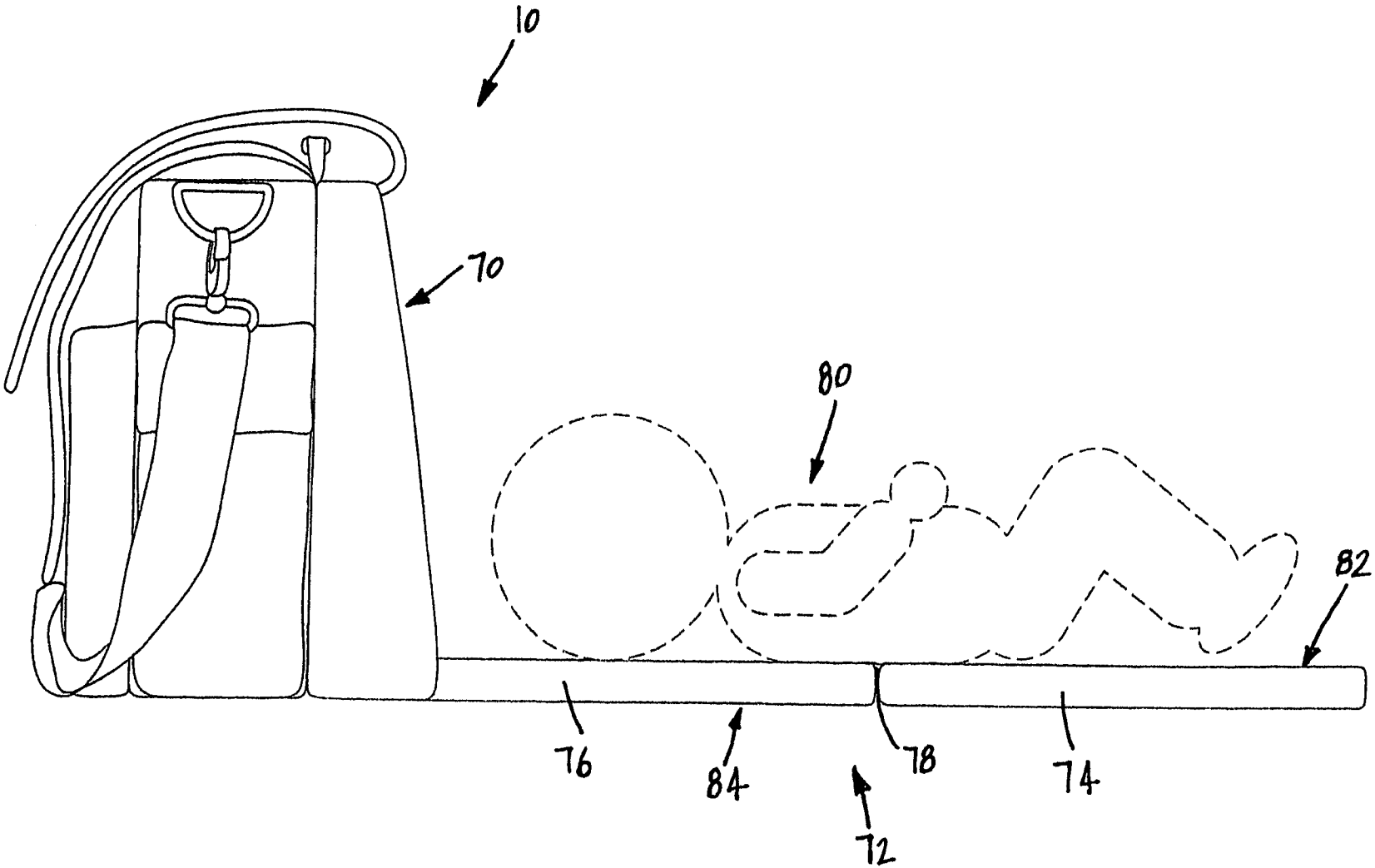
FIG. 8 is a left side view of the diaper bag having an integral changing pad with a changing pad in an extended position and an infant shown in phantom on the changing pad.

FIG. 8 is a left side view of the diaper bag 10 with the changing pad 72 in an extended position and an infant 80 shown in phantom on the changing pad 72. The changing pad 72 is extending out of the interior compartment 70 of the bag 10. The changing pad 72 has the first section 74 connected to the second section 76 by use of the hinge 78. The sections 74 and 76 present a top surface 82 upon which the infant may be positioned. The sections 74 and 76 also have a bottom surface 84 which may be placed on the ground or a changing table. In this manner, the infant 80 may be attended to and have a diaper changed.

As can be appreciated, the angle sides 52 and 62 serve various functions and advantages. One function is that the angle sides 52 and 62 provide a tract for the zipper 24 to be easily operated when unzipping the cover 22. In particular, one hand may be used to unzip the zipper 24 to open the cover 22. The angle sides 52 and 62 provide for a slightly raised and slightly angled zipper track which provides a smooth zipping or unzipping motion with little or no interference in the movement of the zipper 24. If the sides 52 and 62 were not angled but straight, the zipper tract would contact the ground surface and interfere with the movement of the zipper 24. The angle sides 52 and 62 also allow the changing pad 72 to rest or be positioned at an angle when stowed in the bag 10. This allows a more even weight distribution when the pad 72 is in the bag 10 because the pad 72 is tilting back toward the center of the bag 10. With the even weight distribution, the bag 10 is more stable and able to stand upright on a surface. Also, with the pad 72 stored in an angled position in the bag 10, when the cover 22 is opened the pad 72 will not fall out of the bag 10. This prevents the top surface 82 from coming in contact with any unsanitary surface. Further, the angled sides 52 and 62 provide more surface area in the interior compartment 70. This extra area allows for other items to be placed in the interior compartment 70 while still allowing the changing pad 72 to be placed therein and the cover 22 to be closed.

Figure 9:
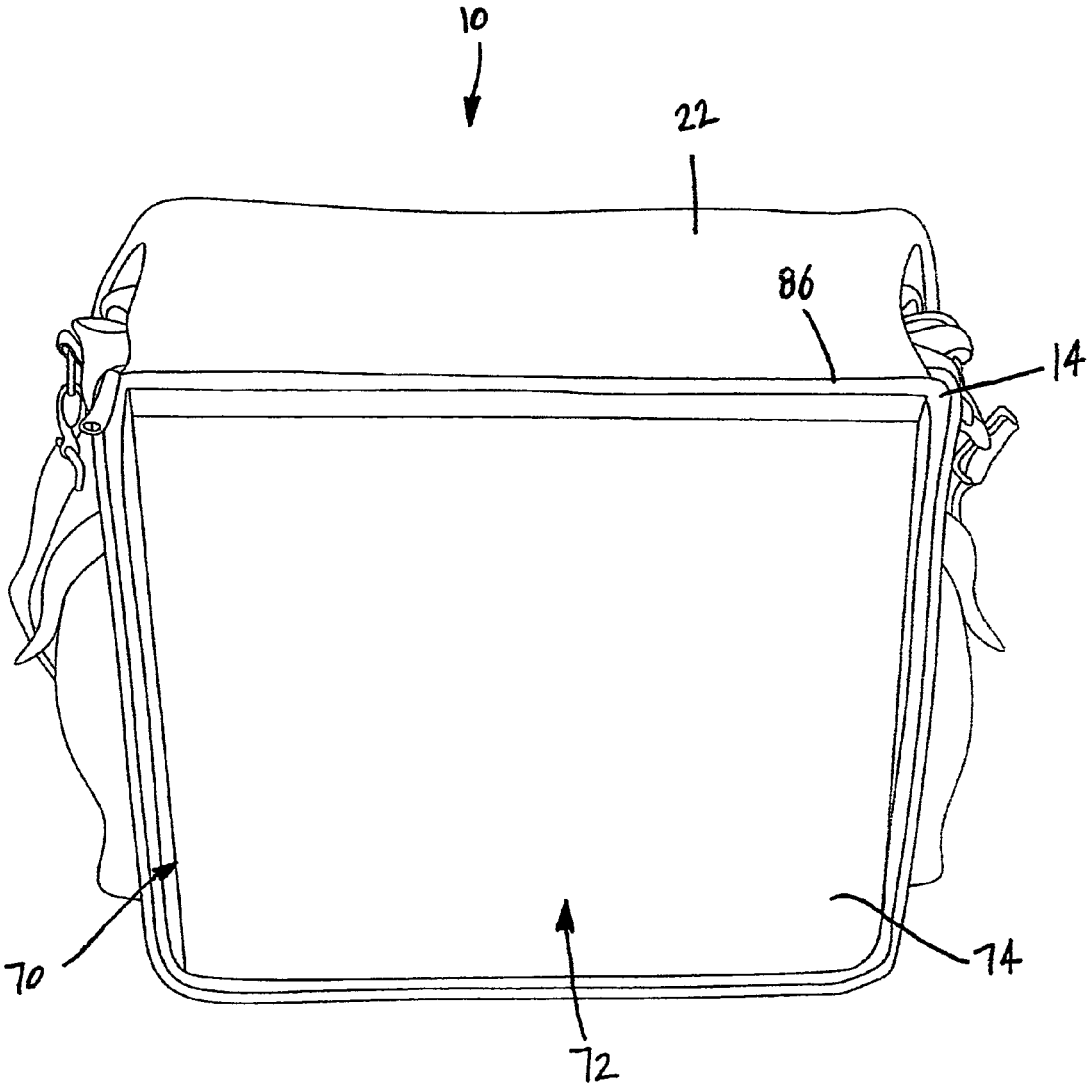
FIG. 9 is a front view of the diaper bag having an integral changing pad with a flap portion being in a folded over position and a changing pad being in a stored position.

With reference now to FIG. 9, a front view of the diaper bag 10 having the cover 22 being in an open position and the changing pad 72 being in a stored position within the interior compartment 70 is shown. The changing pad 72 fits within the interior compartment 70 for easy storage. The cover 22 is connected to the top 14 of the bag 10 by use of a hinge device 86. By way of example only, the hinge device 86 may be an extruded polyolefin living hinge such as McMaster Carr part number 1588A72. However, other hinge devices may be used. It is also possible and contemplated that the hinge device 86 may be fabric or cloth for connecting the cover 22 to the top 14 of the bag 10.

Figure 10:
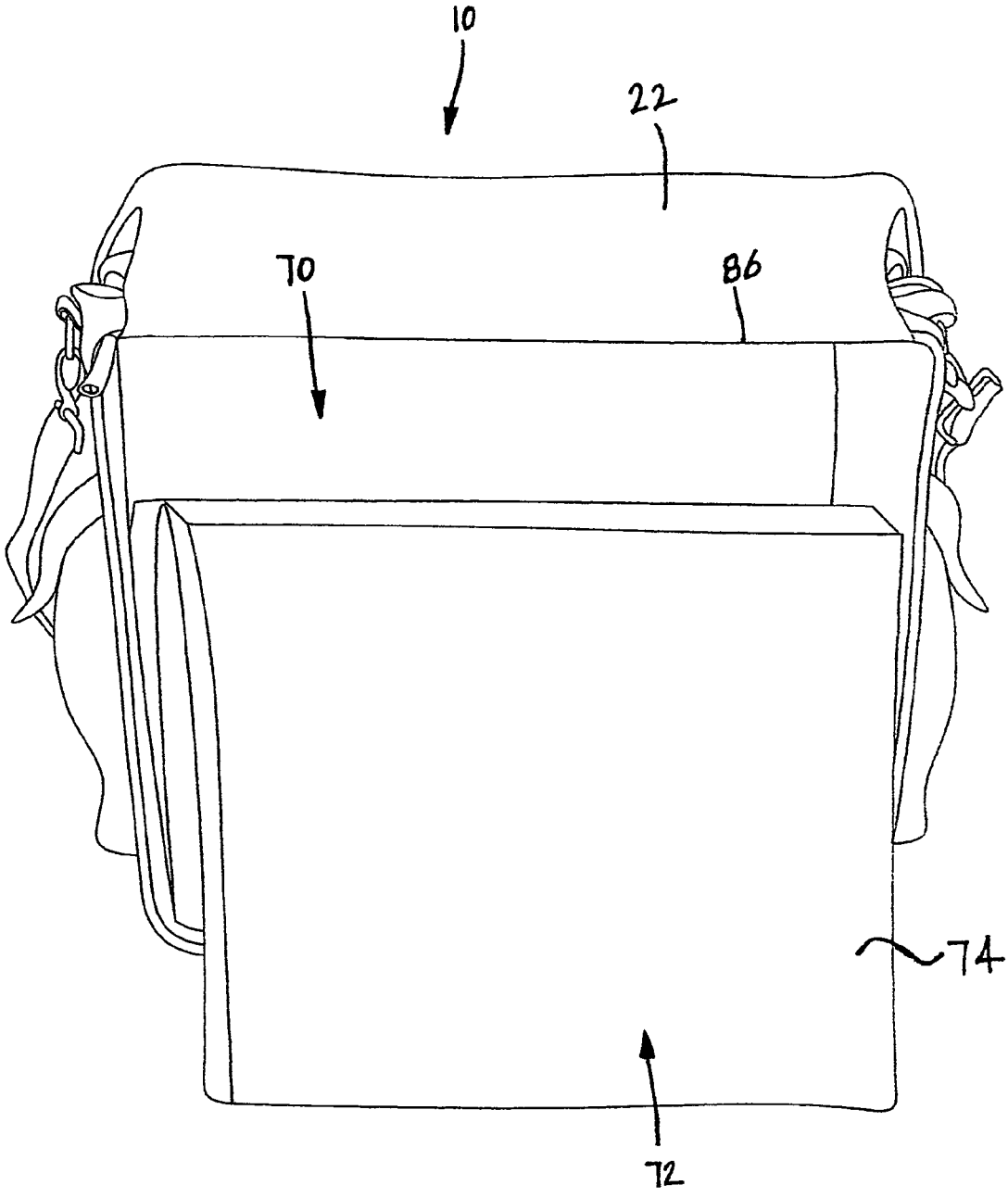
FIG. 10 is a front view of the diaper bag having an integral changing pad with a flap portion being in a folded over position and a changing pad being in a partially extended position.

FIG. 10 is an illustration of a front view of the diaper bag 10 with the cover 22 being in an open position and the changing pad 72 being in a partially extended position. With the changing pad 72 being in a partially extended position the interior compartment 70 is visible. The cover 22 is hinged up over the bag 10 and out of the way of the changing pad 72. With the cover 22 out of the way, the changing pad 72 is easy accessible.

Figure 11:
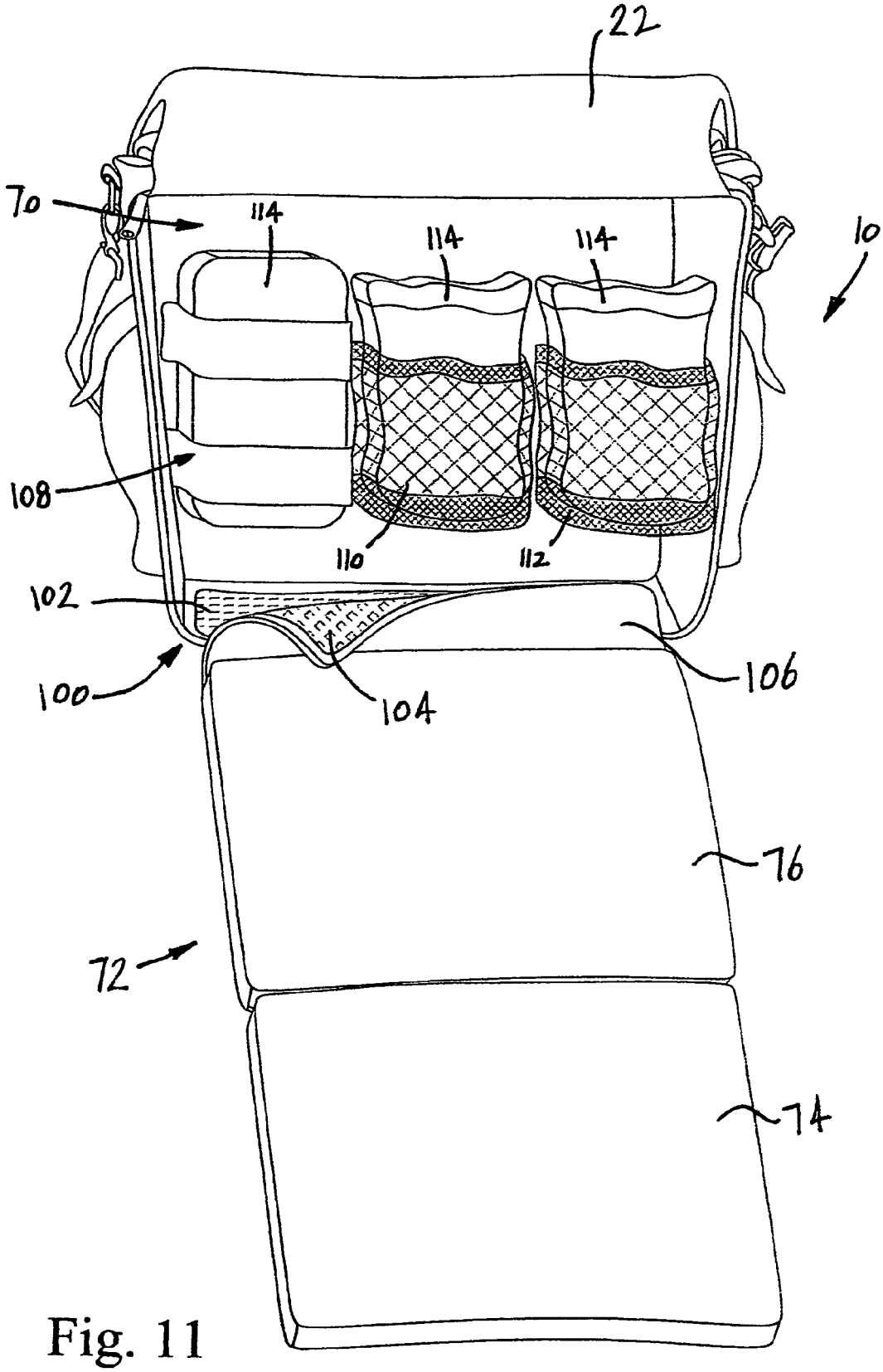
FIG. 11 is a front perspective view of the diaper bag having an integral changing pad with a changing pad being in an extended position and an interior view of the bag being displayed.

A front perspective view of the diaper bag 10 with the cover 22 being in a fully open position and the changing pad 72 being in a fully extended position is shown in FIG. 11. The changing pad 72 has the second section 76 being attached to the bottom 16 of the bag 10 by use of hoop and loop fastening material 100 having a hook portion 102 and a loop portion 104. In this manner, the changing pad 72 is detachably mounted to the bag 10. For example, over time the changing pad 72 may need to be replaced. With the use of the fastening material 100 the changing pad 72 can be easily removed from the bag 10 and replaced. The loop portion 104 may be attached to a flap 106 that is connected to or part of the second section 76. It is also possible to other attachment devices for attaching the changing pad 72 to the bag 10. By way of example only, such attachment devices may include a zipper, snaps, buttons, or other connecting devices. In the interior compartment 70 a number of pockets or storage compartments 108, 110, and 112 are provided for storing baby supplies 114. The storage compartments 110 and 112 are elastic mesh type storage devices. As can be appreciated, various other pockets or storage compartments may be provided in the interior compartment 70 for holding, securing, or storing the baby supplies 114.

Figure 12:
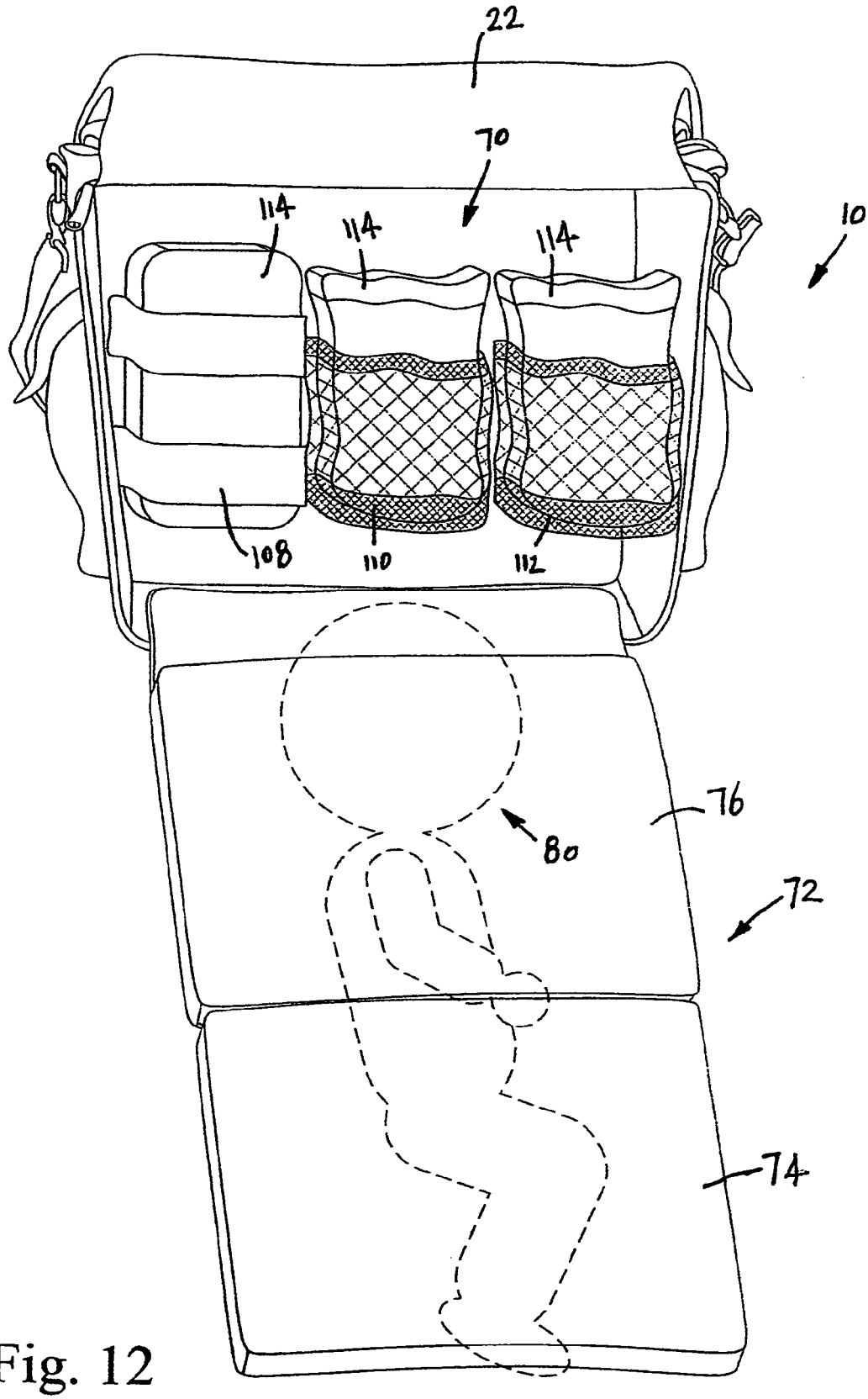
FIG. 12 is a front perspective view of the diaper bag having an integral changing pad with a changing pad being in an extended position and an infant being shown in phantom on the changing pad.

With particular reference now to FIG. 12, a front perspective view of the diaper bag 10 with the changing pad 72 being in an extended position and the infant 80 being shown in phantom on the changing pad 72 is illustrated. In this position the baby supplies 114 can be easily removed from the various compartments 108, 110, or 112 in the interior compartment 70 to be used with the infant 80. As has been previously indicated, the cover 22 is up out of the way allowing for easy access to the various compartments 108, 110, or 112. Further, with the cover 22 folded up over the bag 10, the bag 10 and the changing pad 72 are allowed to lay flat on a surface supporting the bag 10 and the changing pad 72.

In operation the bag 10 is filled with baby supplies 114 prior to an outing. Once on an outing when the infant 80 needs to have a diaper change, the zipper 24 is unzipped to open the cover 22 to gain access to the interior compartment 70. Once the cover 22 is positioned over the top 14 of the diaper bag 10, the changing pad 72 may be deployed by unfolding the changing pad 72 from the interior compartment 70. The sections 74 and 76 of the changing pad 72 may be positioned on the ground, the floor, a table, a bench, or a public changing station. The infant 80 may then be placed on the changing pad 72. The changing pad 72 is both safe and comfortable for the infant 80. The baby supplies 114 are easily accessible in the interior compartment 70 and the infant 80 is in easy reach of any individual using the bag 10. Once the diaper has been changed, the infant 80 is removed from the changing pad 72 and the changing pad 72 is folded back up into the interior compartment 70. The cover 22 is then moved back into position to cover the interior compartment 70 and the zipper 24 is zipped. As has been previously discussed, the changing pad 72 may be easily detached from the bag 10 by use of the hook and loop fastening material 100.

It should be recognized that the diaper bag having an integral changing pad 10 of the present disclosure could be constructed of various materials such as fabric, cloth, leather, vinyl, plastic, or other suitable flexible lightweight material. The diaper bag having an integral changing pad 10 may also be constructed of a machine washable fabric that resists food, liquid, moisture, germs, and bacteria. It is also possible that the diaper bag having an integral changing pad 10 may be constructed of a material that is treated with a chemical that repels liquids and microbes. Preferably, the diaper bag having an integral changing pad 10 is formed of relatively light-weight material so that the bag 10 can be easily manufactured, assembled, transported, stored, and employed for the intended use of the bag 10. Further, the interior compartment 70 and the pockets 108, 110, and 112 can be constructed of similar materials to facilitate cleaning of the bag 10. As can further be appreciated, the diaper bag 10 may be constructed in one or more colors or patterns. Furthermore, although not shown, it is possible that the changing pad 72 may comprise three sections instead of the two sections 74 and 76. It is also possible to have a fitted sheet placed on the changing pad 72 for securing the infant 80 on the changing pad 72 to allow the infant 80 to nap or sleep on the changing pad 72. The bag 10 can include various other pockets, sections, compartments, or elastic mesh storage units as may be desired.

From all that has been said, it will be clear that there has thus been shown and described herein a diaper bag having an integral changing pad. It will become apparent to those skilled in the art, however, that many changes, modifications, variations, and other uses and applications of the subject diaper bag having an integral changing pad are possible and contemplated. All changes, modifications, variations, and other uses and applications which do not depart from the spirit and scope of the present disclosure are deemed to be covered by the present disclosure, which is limited only by the claims which follow.

What is claimed is:

1. A diaper bag having an integral changing pad comprises:

a bag having an interior compartment with the bag having a top portion and a bottom portion;

a cover for covering the interior compartment with the cover attached to the top portion for folding the cover over the top portion of the bag; and a changing pad having a first pad section attached to a second pad section and the second pad section attached to the bottom portion with the first pad section and the second pad section being folded up in the interior compartment with the cover completely covering the interior compartment and the changing pad when the changing pad is folded up in the interior compartment, and being unfolded out of the interior compartment when the cover is folded over the top portion of the bag.

2. The diaper bag having an integral changing pad of claim 1 wherein the second section is connected to the bottom portion by use of hook and loop fastening material.

3. The diaper bag having an integral changing pad of claim 1 wherein the cover is attached to the top portion by use of a hinge.

4. The diaper bag having an integral changing pad of claim 1 wherein the interior compartment comprises a pocket for holding items.

5. The diaper bag having an integral changing pad of claim 1 wherein the changing pad is foldable along the attachment between the first pad section and the second pad section.

6. The diaper bag having an integral changing pad of claim 1 further comprising an exterior portion and a pocket positioned on the exterior portion.

7. The diaper bag having an integral changing pad of claim 1 wherein the cover is attached to the bottom portion by use of a zipper.

8. The diaper bag having an integral changing pad of claim 1 wherein the first pad section is attached to the second pad section by use of a hinge.

9. The diaper bag having an integral changing pad of claim 1 wherein the changing pad further comprises a third pad section attached to the first pad section.

10. A diaper bag having an integral changing pad comprising:

a bag having an interior compartment having a top, a bottom, and a pair of angled sides;

a cover for covering the interior compartment with the cover attached to the top for folding the cover over the top of the bag; and a changing pad having a first portion connected to a second portion with the second portion being detachably mounted to the bottom of the interior compartment, the angled sides allowing the changing pad to be placed in a tilted positioned within the interior compartment to prevent the changing pad from falling out of the interior compartment when the cover is folded over the top of the bag, with the cover completely covering the interior compartment and the changing pad when the changing pad is folded up in the interior compartment.

11. The diaper bag having an integral changing pad of claim 10 wherein the changing pad is foldable along the connection between the first portion and the second portion.

12. The diaper bag having an integral changing pad of claim 10 wherein the second portion is detachably mounted to the bottom by hook and loop fastening material.

13. The diaper bag having an integral changing pad of claim 10 wherein the cover is attached to the top by a hinge.

14. The diaper bag having an integral changing pad of claim 10 wherein the pair of angled sides have a top having a length and a bottom having a length and the length of the bottom is greater than the length of the top.

15. The diaper bag having an integral changing pad of claim 10 wherein the pair of angled sides provide a pocket into which the changing pad may be folded.

16. A diaper bag having an integral changing pad comprising:

a bag having a central body portion and an interior compartment with the bag having a top portion and a bottom portion, and a pair of angled sides extending out from the central body portion with each of the angled sides having a top and a bottom with the tops each having a length and the bottoms each having a length and the length of each of the bottoms being greater than the length of each of the tops;

a cover for covering the interior compartment with the cover attached to the top portion for folding the cover over the top portion of the bag; and a folding changing pad having a top edge and a bottom edge with the bottom edge being attached to the bottom portion of the bag with the changing pad being folded up in the interior compartment or unfolded out of the interior compartment with the angled sides allowing the changing pad to be placed in a tilted positioned within the interior compartment to prevent the changing pad from falling out of the interior compartment when the cover is folded over the top of the bag, with the cover completely covering the interior compartment and the changing pad when the changing pad is folded up in the interior compartment.

17. The diaper bag having an integral changing pad of claim 16 wherein the bottom edge is attached to the bottom portion by use of hook and loop fastening material.

18. The diaper bag having an integral changing pad of claim 16 wherein the changing pad is detachably mounted to the bottom portion of the bag.

19. The diaper bag having an integral changing pad claim 16 wherein the cover is attached to the top portion by use of a hinge.

20. The diaper bag having an integral changing pad of claim 16 wherein the interior compartment further comprises a pocket for storing items.

* * * * *